US005615505A

United States Patent [19]

Vaid

[11] Patent Number: 5,615,505

[45] Date of Patent: Apr. 1, 1997

[54] MAGAZINE CARTRIDGE GUIDE

[75] Inventor: Pardip K. Vaid, Northampton, Mass.

[73] Assignee: Smith & Wesson Corp., Springfield, Mass.

[21] Appl. No.: 504,505

[22] Filed: Jul. 20, 1995

[51] Int. Cl.[6] ..... F41A 9/61

[52] U.S. Cl. ..... 42/50; 42/7; 42/60; 42/89; 42/18

[58] Field of Search ..... 42/50, 7, 60, 89, 42/18

[56] References Cited

U.S. PATENT DOCUMENTS

| | | | |
|---|---|---|---|
| 2,429,831 | 10/1947 | Lippert et al. | 42/50 |
| 2,895,248 | 7/1959 | Sawin | 42/50 |
| 3,890,729 | 6/1975 | Frisoli | 42/7 |
| 4,502,237 | 3/1985 | Krogh | 42/50 |
| 4,520,585 | 6/1985 | Barrett | 42/7 |
| 4,574,509 | 3/1986 | Smith | 42/7 |
| 4,592,160 | 6/1986 | Bross | 42/7 |
| 4,747,224 | 5/1988 | Smith | 42/7 |
| 5,014,456 | 5/1991 | Kurtz et al. | 42/50 |
| 5,099,595 | 3/1992 | Chesnut et al. | 42/50 |
| 5,153,359 | 10/1992 | Lishness | 42/50 |
| 5,320,023 | 6/1994 | Erdem | 89/195 |
| 5,386,657 | 2/1995 | Racheli | 42/50 |
| 5,388,360 | 2/1995 | Fortunato | 42/50 |
| 5,461,811 | 10/1995 | Ciener | 42/50 |

FOREIGN PATENT DOCUMENTS 0248772 9/1987 European Pat. Off. .

*Primary Examiner*—Charles T. Jordan
*Assistant Examiner*—Meena Chelliah
*Attorney, Agent, or Firm*—McCormick, Paulding & Huber

[57] ABSTRACT

An improved magazine for a semi-automatic pistol adapted to be loaded with a plurality of horizontally oriented and vertically stacked cartridges or bullets. A follower on the upper end of a coil spring supports the stack of rounds which are fitted individually into the top opening of the magazine with the first being disposed on the follower and subsequent rounds being supported by the body of the previous round. The last loaded, or uppermost round, when the magazine is fitted into the gun, will be the first round to be loaded into the chamber of the gun for firing. At the upper sidewalls thereof, the magazine includes lips which, at upper edges, are spaced apart a distance less than the diameter of the cartridges to be used in the pistol. A ridge disposed in each of the side walls of said magazine parallel to the upper edges of said lips, the ridges are spaced apart a distance less than the diameter of the cartridges which are held thereby. The magazine including a convexly curved front wall with a bridging member are disposed in upwardly extending angular orientation and being of upwardly facing concave configuration for guiding short rounds to clear the front wall of the magazine and to guide the same onto the guide ramp for movement into the chamber of the barrel.

7 Claims, 2 Drawing Sheets

MAGAZINE CARTRIDGE GUIDE

FIELD OF THE INVENTION

This invention relates to magazines for semi-automatic handguns and, more particularly, to the magazine being adapted to overcome the occurrences of misfires and jams resulting from the use in such magazines of shorter than conventional length cartridges, including hollow point and flat nose bullets.

BACKGROUND OF THE INVENTION

In the firearms industry, it has long been the practice to provide cartridge magazines in which each of a plurality of cartridges is generally horizontal, or with its centerline oriented at an angle for being rammed into the chamber of the barrel and wherein all the rounds are vertically stacked. A follower on the upper end of a coil spring supports the vertical stack of rounds. In loading the magazine, the rounds are fitted individually into its open, upper end with the first round being disposed on the follower and subsequent rounds being supported by the body of the preceding round. The last loaded, or uppermost round will be the first round to be loaded into the chamber of the gun barrel when the magazine is fitted into the gun to ready the same for firing. After each round is fired, the next and successive rounds are fed upwardly by the follower and coil spring to the uppermost position in the magazine at which each round is disposed prior to being rammed into the chamber of the gun.

Typically, such magazines include lips disposed along the spaced upper edges of the magazine side walls. The lips usually have upper edge portions that extend inwardly from the side walls of the magazine and serve to retain the uppermost round in position in the magazine to be fed into the chamber of the gun barrel. The transfer or feeding of rounds successively from the magazine into the chamber is in response to energy of recoil imparted to the slide which compresses and energizes the recoil spring. That spring expands to return the slide and breech block carried therein to the "ready position" of firing mechanism.

As the breech block is moved toward its "closed" position with the uppermost cartridge in the magazine disposed in its path of movement, the breech block engages the rear surface of the cartridge case a substantial distance above the centerline of the bullet. That distance defines a moment arm whereby the force exerted by the breech block causes the forward end of the round to dip or pitch downward as it moves forwardly. That tendency of the uppermost round is further compounded by the after-end of the upper round being lifted somewhat by upward movement of the penultimate round as it is being thrust upward to replace the top round. Upon the top round being rammed toward the breech clears the front wall of the magazine, it engages an inclined ramp on the frame at the breech end of the barrel for guiding the round upwardly into the chamber of the barrel.

The dimensions and configuration of a magazine are selected for use in the particular gun in which the magazine is to be used and with conventional size rounds. The drawbacks of using with this type of magazine are generally encountered only when one attempts to use rounds of ammunition, such as flat or hollow nose bullets, which are substantially shorter in length than conventional rounds. In particular, during that portion of the loading cycle whereby each round is transferred, or fed from the magazine into the chamber of the pistol barrel, the shorter rounds have a greater tendency to engage the forward wall of the magazine tube wall. When this occurs, a serious jam can result which prevents proper loading and firing of the gun.

Past attempts to prevent such jamming, as disclosed in U.S. Pat. Nos. 2,895,248 and 5,153,359, have included a tab 50 disposed on the outer end of a separate element 38 or a ramp 64 on the upper edge of the forward wall 46 of a magazine 10. Such ramps or tabs, as disclosed in the prior art, may help to prevent shorter rounds from becoming jammed against the tube wall or during feeding. This type of solution has not, however, solved the problems of such rounds jamming against the barrel feed ramp.

Moreover, that type of solution has not generally proven totally effective, especially if used in conjunction with a fixed barrel, as contrasted with a dropping barrel in which the breech is actually lowered towards the upper edge of the magazine tube. In the former situation, the fixed breech remains vertically offset a relatively large distance from the upper edge of the magazine tube and, as a result, if the round does not approach the feed ramp at the proper angle, a jam may result.

Indeed, in recent years, with the advent of semi-automatic handguns, such as high powered compact pistols of the 0.45 caliber and 9 mm types, the instances of jamming and cartridge feed malfunctioning have increased markedly. U.S. Pat. No. 5,014,456 assigned to Smith & Wesson Corp., the same assignee as this Application, carefully analyzed the problems associated with greater recoil velocity and cartridge feed malfunctions and pistol jamming. It was found that because of the greater kinetic energy of the slide, upon its impacting against the frame, a greater tendency was noted on recoil of such pistols for the upper cartridges to shift or move forward in the magazine. As a result, the uppermost round may not only be disoriented which renders problematic its accurate feeding to the chamber of the barrel but in some extreme cases, the round may even be dislodged from the magazine.

The above referenced U.S. Pat. No. 5,014,456 sought to provide a solution for such dislodgement problems by providing control and guide means to retain the upper round so that it is unable to shift forwardly or otherwise out of proper alignment for feeding into the barrel. The same means also acted to cam the penultimate round so it will be properly repositioned for its movement to the top position in the magazine.

DISCLOSURE OF THE INVENTION

It is a principal object of this invention to provide an improved cartridge magazine for a handgun which overcomes the problems of the prior art magazines.

It is an additional object of this invention to provide an improved magazine which reduces the incidence of jamming while feeding shorter than conventional cartridges therefrom.

According to this invention, a magazine for housing and dispensing cartridges into the chamber of a semi-automatic pistol comprises a rear wall, spaced parallel side walls and a front wall. The magazine is "open" at its upper end and the upper edges of the side walls are provided with spaced, opposed and inwardly extending lips defined in part by upper edge portions which serve to retain the upper round in the magazine against the upward force of a magazine coil spring and follower. Inwardly extending ridges are formed in opposed side walls of the magazine and with each ridge disposed a predetermined distance from and generally parallel to the upper edge portion of each of the retaining lips.

The distance between each of said ridges and said upper edge portion of the lips is less than the outer diameter of the cartridges, whereby the upper round is not only oriented and retained by the lips and ridges, but it is also positively guided toward contact with an upwardly inclined guide ramp for guiding the round into the chamber of the gun. The guiding of said round is accomplished in part by a bridging member formed on the upper edge portion of the front wall of the magazine.

The above and other objects and advantages of this invention will be more readily apparent from a reading of the following description of an exemplary embodiment thereof taken in conjunction with the following drawings.

DETAILED DESCRIPTION OF THE PREFERRED EMBODIMENT

Figure 1:
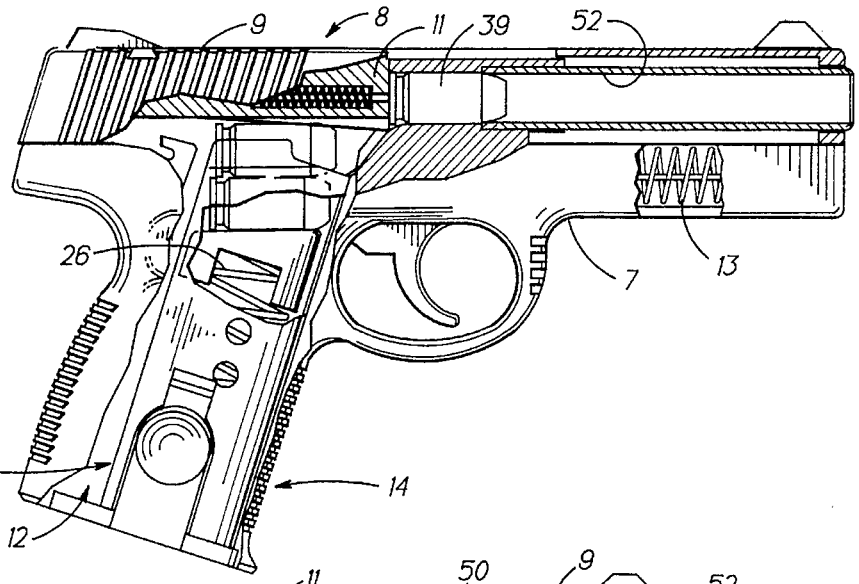
FIGS. 1, 2 and 3 are side elevational views partly in section of a semi-automatic pistol equipped with a magazine guide of the type embodying this invention, in different operative positions to illustrate the operation thereof.

Shown in FIG. 1, is a semi-automatic pistol 8 comprises a frame 7, a slide 9 movable on the frame and carries a firing pin and breech mechanism 11. Upon firing the pistol, a cartridge 39, disposed in the chamber 50 of barrel 52, is discharged from the barrel and the slide 9 recoils in response to blow-back of the expanding gasses. A recoil spring 13 will be compressed and its subsequent expansion will return the slide to its ready position. The pistol 8 is further equipped with a cartridge magazine 10 of the type which embodies this invention and which slidably interfits within a cavity 12 disposed in the handgrip 14 of the pistol.

The magazine 10 of FIGS. 4–9 comprises a tubular housing 16 defined by a radiused front wall 18, laterally spaced, parallel side walls 20 and 22 and a planar rear, or back wall 24 generally perpendicular to the side walls thereof. A coil spring 26 is disposed within the tubular housing 16 with its lower end seated against a butt plate 30 and its upper end is disposed within the hollow underside of a follower 36. The follower 36 (FIG. 4) has a planar upper surface 37 adapted to support a cartridge 39 in general alignment with the barrel 52 of the pistol 8. A plurality of additional rounds are adapted to be vertically stacked in superposed relation on the upper surface of the first round 39 disposed on the follower 36.

Figure 8:
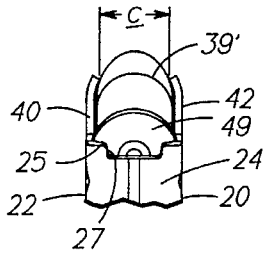
FIG. 8 is a partial rear elevational view of the magazine.
Figure 9:
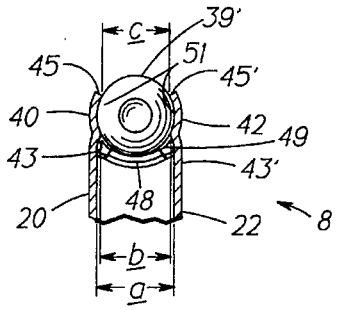
FIG. 9 is a section taken along line 9—9 of FIG. 5.
Figure 6:
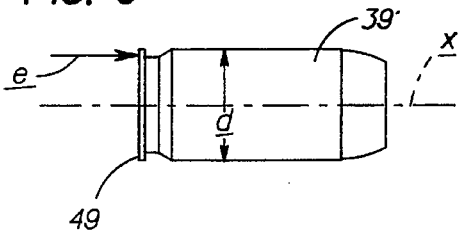
FIG. 6 is an elevational view, on an enlarged scale, of a cartridge of the type used in the magazine embodying this invention and which is intended to illustrate the off-center engagement of the breech block with the cartridge rim.

As best shown in FIGS. 6 and 9, the side walls 20 and 22 of the magazine housing, or tube 16 are spaced apart a distance a slightly greater than the diameter d of the cartridges 39 adapted to be received therein. That dimensional relationship provides for the easy vertical movement of stacked rounds as they are being successively fed upwardly from the lower region of the magazine to the uppermost position, as shown at 39' in FIGS. 2, 3 and 7–9, and from which position that round will be transferred into the chamber 50 of the barrel 52.

The upper edge portions of the side walls 20 and 22 comprise a pair of spaced, opposed lips 40 and 42. The lips 40 and 42, as best shown in FIG. 9, are characterized by a lateral distance c between the inner edge corner portions 45 and 45' of the outer edges of the lips 40 and 42 which is less than the diameter d of the cartridges 39 carried in the magazine 8. This dimensional relationship and the inner corner portions 45 and 45' of the outer edges of lips 40 and 42 serve to prevent the uppermost round 39' being moved beyond the lips by a force exerted upwardly by coil spring 26.

Figure 7:
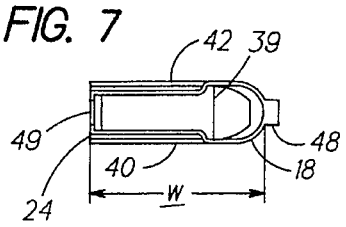
FIG. 7 is a top plan view of the magazine.

It has been found that in magazines of the type used for semi-automatic pistols that cartridges are prone to move from side-to-side as they are being fed from such magazines. It has been postulated that such movement results in part from the fact that the uppermost round has virtually only line contact with the underlying round and once control of that round by the lips has been lost, the round is free to continue to move along that line or to slip either to the right or left thereof. Another factor that contributes to the gun being jammed is the upper round being dislodged from its "ready-to-load" position, in which the rim 49 of the cartridge is disposed against the back wall 24, as shown in FIG. 7. In this connection, upon recoil of small but high powered pistols, the forces exerted by the slide 9 impacting against the frame 7 has a greater tendency than larger size guns to cause forward creep or dislodgement of the rounds from their normal position in the magazine. This problem can be fairly severe in certain types of pistols whereby it has been found that absent the ridges 43 and 43' (FIG. 9), the uppermost round would be subjected to inertial dislodgement. As a result of such forces, that round may be moved a substantial distance forward of the rear wall 24 of the magazine 8 and, in some cases, the round may even be expelled from the magazine.

Inertial dislodgement has been found to be particularly problematic with respect to new lightweight polymer handguns of relatively high caliber. The problem is even more acute in the present application wherein the preferred embodiment includes a polymer frame in combination with a relatively light weight slide. As a result, the magnitude of the recoil force is relatively large which tends to cause such "inertial dislodgement." Recoil force is a function of the kinetic energy (KE) of the moving slide which is equal to one-half (½) $mv^2$ and is the product of m, the weight of the slide and the velocity $v^2$ imparted to the slide by the energy generated by the explosion of the gun powder of a round having been fired in the chamber of the gun. In applications such as the compact handgun of the present invention, the slide is, by design, smaller in size and lighter in weight by virtue of its die-cast construction. These factors all contribute to greater kinetic energy which varies as the square, or exponential increase in the velocity as compared to the arithmetic decrease in the weight of the slide. The above factors contribute to a strong impact force being imparted to the frame.

At the lower edges of the lips 40 and 42, each of the side walls 20 and 22 of the magazine includes an inwardly extending ridge 43 and 43', which is best illustrated in FIG. 9, extends generally parallel to each of the upper edges, or corners 45 and 45' of the lips. The opposed innermost edges of the ridges are laterally spaced apart a distance b which is substantially smaller than the distance a between the inner surfaces of the side walls 20 and 22 and also smaller the diameter d (FIG. 6) of the cartridges 39 adapted to fit within the magazine 8.

Figure 2:
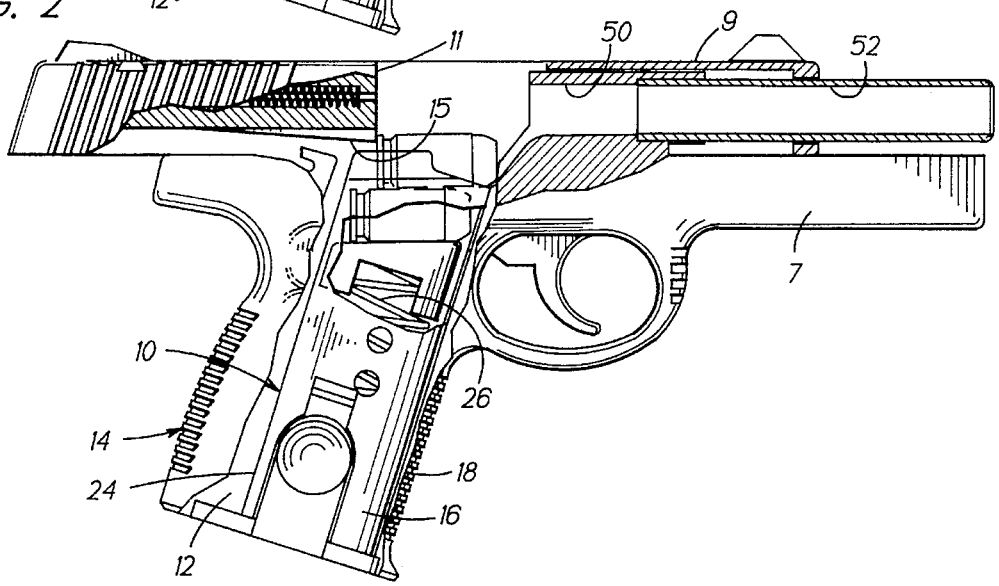
Figure 3:
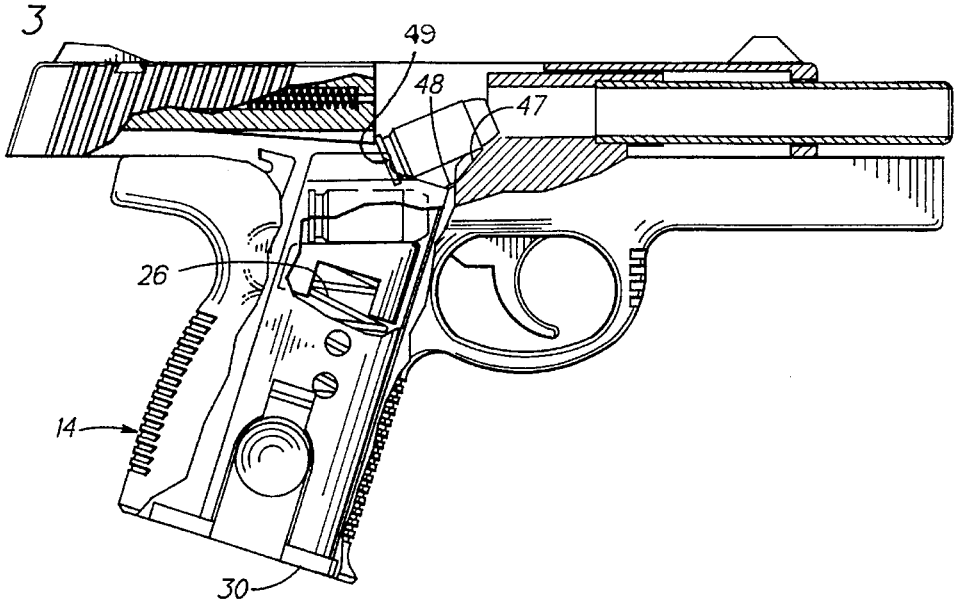

The ridges 43 and 43' fair smoothly inward from the adjacent inner surfaces of the resilient side walls 20 and 22 so that the magazine walls will yield, or be deflected outward sufficiently to permit the cartridge casing 39 to be moved upwardly between the ridges 43 and 43' by force being exerted by the coil spring 26. On the other hand, however, the inner surfaces of the lips 40 and 42 above the ridges are generally of concave configuration, as at 51 in FIG.9, that corresponds generally to the outer surfaces of the cartridges. As a result, once the round has moved upwardly past the ridges 43 and 43', its outer surface interfits closely with the concave inner surfaces 51 of the lips. In effect, the cartridge is "captured" between the upper edges 45 and 45' of the lips and the upper side surfaces of the ridges 43 and 43' and, in essence, it has only one path of movement, i.e., toward the inclined ramp 47 on the breech end of the chamber 50 (FIGS. 2 and 3). The lateral spacing c between the inner edges 45 and 45' of the lips 40 and 42 is substantially less than the diameter d of the cartridges 39 such that the top round 39' (FIG. 9) will be held securely between the opposed lips and ridges while enabling the round to be rammed into the chamber 50 from its position therebetween.

The lips 40 and 42 are of a length such that they terminate at a distance from the back wall 24 of the magazine of approximately 60% of the overall width w (FIG. 7) of the side walls of the magazine. Each of the lips 40 and 42 includes a radiused rear edge portion 53 and which, at its lower end, intersects with the back wall 24 at shelf portions 25 which include a generally horizonal outer edge portion. An upwardly opening U-shaped slot 27 (FIG. 8) is disposed centrally of the back wall 24 at the upper edge portion thereof and provides a path for movement of the ridge or keel portion 15 disposed along the lower edge of the breech block 11 (FIG. 2) into contact with the upper edge portion of the rim 49 of the cartridge 39'. Being oriented by the magazine, including its lips 40 and 42 and ridges 43 and 43', the cartridge 39' is guided thereby as it is being moved forwardly by the keel 15 of the breech block 11 toward the inclined ramp 47 and then upwardly along ramp 47 and into the chamber 50 of the barrel 52.

As best illustrated in FIGS. 3 and 6, the keel 15 engages the upper edge portion of the rim 49 of the uppermost cartridge in the magazine, as shown in FIG. 8. As a result, the point of contact of the keel 15 and the rim 49 is offset by a moment arm e relative to the axis x of the cartridge. Because of the eccentric nature of the driving force e applied to the rim of the cartridge by the keel, the round 39' has a tendency to dip or nose downward as it moves forwardly from the magazine toward the inclined ramp 47.

Despite the relatively strong recoil forces, it has been found that the combination of the ridges 43 and 43' and the edges 45 and 45' of the lips 40 and 42 which engage the cartridge along two parallel lines on opposite sides of the cartridge with an interference fit which overcomes the problems cartridge creep and dislodgement encountered in high recoil pistol applications, as disclosed herein. With the short rounds, however, there is still an occasional problem of jamming which results from such rounds impacting nose first at too steep an angle and/or at a point too low on the inclined ramp. In that connection, for any short round which just clears the forward wall 18 of the magazine tube "by a nose", there is a tendency for such rounds to approach the ramp at too sharp an angle, i.e., one that is substantially less oblique than that of a conventional round. In such cases, there is a greater likelihood of the short rounds jamming rather than being guided by the ramp 47 into the chamber.

Figure 4:
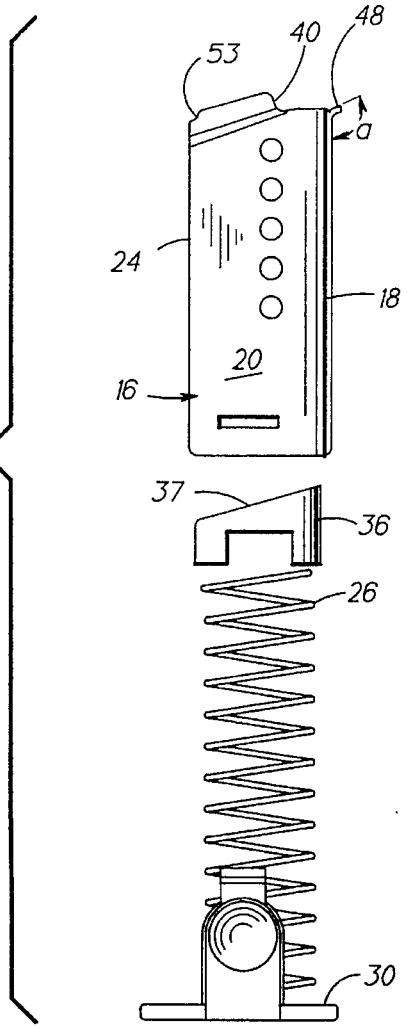
FIG. 4 is an exploded elevational view of the magazine removed from the pistol.
Figure 5:
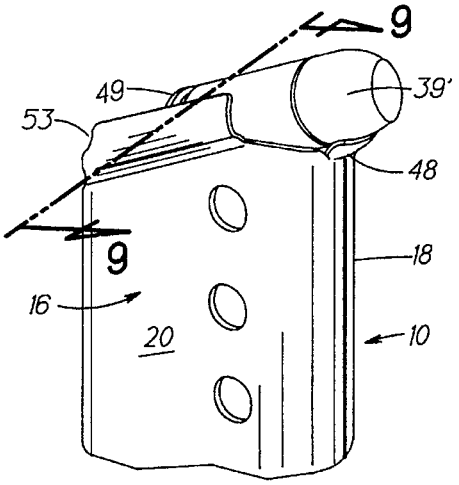
FIG. 5 is a partial perspective view of the magazine shown on an enlarged scale.

As shown in FIGS. 3–5, 7 and 9, a guiding or bridging member 48 is disposed at the upper edge of the forward wall 18 of the magazine and extends upwards at a predetermined oblique angle from the wall 18. In a preferred embodiment, as shown in FIG. 4, the bridging member 48 is disposed at an angle a of approximately 130 to 150 degrees relative to the forward wall 18. Moreover, in the preferred embodiment, the forward wall is generally semi-cylindrical in construction, whereby the bridging member 48, in the form of an upwardly facing concave surface that extends radially outward and upwardly from the upper edge portion of the front wall 18 thereof, is best shown in FIGS. 4 and 5. With the magazine 10 fully inserted into the handgrip cavity 12 of the handgun, as shown in FIG. 3, the bridging member 48 will be disposed at the lower end of the upwardly inclined feed ramp 47 and because of the orientation and configuration thereof, it serves as a guide in both a horizontal or lateral plane and a vertical plane or plane normal to the lateral plane.

Disposed at an angle a, the member serves to cam the cartridge or bullet 39 upwards so that it engages the ramp 47 at a higher point on the ramp and at a more oblique angle than would otherwise be the case, especially when using shorter cartridges with flat nose or hollow point bullets. In addition, it has been found that the timing of feeding and chambering of a cartridge is an important criterion in the operation of such semi-automatic pistols. In this connection, if a round should contact the ramp at a point too remote from the entrance to the chamber 50, it would probably take too long to chamber such rounds, thereby encouraging jamming. Member 48 ensures the round being fed across the member 48 will contact the inclined ramp 47 substantially closer to the chamber entrance to thereby speed up the chambering action. This is especially important with fixed barrel configurations, as disclosed herein, since the vertical distance between the top of the magazine and the chamber is greater than in a pistol with a drop barrel. In addition, the fixed barrel, as herein disclosed, has a feed ramp 47 that is at a substantially steeper angle than is a ramp for a drop barrel. Accordingly, the member 48 provides a smooth transition from the magazine to the ramp, as shown in FIGS. 3–5 and 9 for any round which is properly oriented within a few degrees of one precisely directed toward the central axis of the ramp 47. Thereupon, the guide member would be able to simply funnel the round to the preferred contact point on the ramp and rectify any small errors in the angular orientation or attitude of the round as it approaches the contact point.

The bridging member 48 comprises an upwardly angled and upwardly "open" channel of concave configuration adapted to guide cartridges which may otherwise cause jamming of the loading sequence. As long as the nose of the round being fed into the chamber falls within the width of the member 48 which may be on the order of 0.125–0.25 inch and a length of about 0.0625–0.125 inch to fit within the void between the front wall of the magazine and the lower edge of the ramp 47 which, in the prototype, is on the order of 0.125 inch. The member 48, in accordance with this invention, is capable of reducing the incidence of jams in the operation of a small light-weight semi-automatic of the type depicted herein.

OPERATION

As shown in FIG. 3, the slide 9 is in its fully recoiled position relative to the frame of the handgun and the rim 49 of the uppermost cartridge 39' is disposed in the path of movement of the keel 15 of the breech block between the lips 40 and 42 and ridges 43 and 43' of the magazine tube. Being so retained therein by a secure "interference fit", the magazine prevents forward movement of that cartridge, in response to recoil, from its normal position with its rim 49 disposed against the rear wall 24 of the magazine. As the slide begins to move forward, the forward end of the keel 15 engages the rim 49 above the U-shaped cutout 27 (FIG. 8) whereby the cartridge 39' will be driven forwardly from within the lips 40 and 42 and ridges 43 and 43'. As discussed above, the force exerted upon the upper edge portion of the rim 49 will cause the front end of the round to dip downwardly as it moves sufficiently to clear the lips of the magazine. In many prior art applications, this "dip" has been responsible for jamming, particularly when cartridges having flat or recessed tipped bullets become caught on a generally vertical forward surface of the magazine tube.

As shown in FIGS. 4 and 9, as the cartridge 39 is being moved forward by the keel 15, the bullet portion thereof will engage the bridging member 48 whereby the forward end of the cartridge is guided toward the guide ramp 47 of the barrel 52 as it continues to move forward. During such forward movement, as discussed hereinabove, the rear portion of the cartridge remains securely engaged by the forward portions of the lips 40 and 42 and ridges 43 to maintain the cartridge in alignment with the concave upper surface of the member 48. As the cartridge continues to be moved forward by the keel 15, the round 39 slides over the member 48 toward a position on the inclined ramp 47 from which it is simply deflected or cammed into the chamber 50 of the barrel.

Having thus described the invention, what is claimed is:

1. An improved cartridge magazine for housing therein a plurality of vertically stacked cartridges for successively dispensing and guiding the uppermost cartridge of a plurality of vertically stacked cartridges from the magazine toward an inclined ramp leading to a chamber of a barrel of a semi-automatic pistol and in which the magazine spring is disposed in the lower end portion of the magazine for urging the cartridges upwardly toward the upper edge portion of the magazine, said improved magazine comprising:

front, rear and generally parallel and resiliently flexible side walls, a pair of cartridge retaining lips with each of said cartridge retaining lips disposed along a respective upper edge portion of each of the side walls, and a pair of cartridge retaining, elongated ridges disposed in spaced opposed relation to one another, each of said ridges being disposed on and extending a substantial distance along a respective side wall between said front and rear walls at a predetermined location below and generally parallel to each retaining lip, said ridges extending inwardly from opposed side walls of the magazine and spaced apart a distance less than the diameter of said cartridges, the side walls being laterally deflectable outwardly to enable successive upward movement of the cartridges between said ridges and the lateral deflection being determined by the relationship of the cartridge diameter to said distance between said ridges, to the flexibility of said side walls, the upward force exerted by the magazine spring on the cartridges and the configuration of the ridges in the direction of movement of said cartridges thereover, said lips and said ridges thereby engaging an uppermost cartridge positioned between said lips and said ridges and guiding the cartridge between said magazine and the inclined ramp.

2. The improved magazine, as set forth in claim 1, wherein said front wall is of radiused configuration with a concave inner surface and wherein a bridging member is disposed at the upper edge portion of the front wall to guide the uppermost cartridge in its movement toward said ramp as it is dispensed from said magazine.

3. The improved magazine, as set forth in claim 1, wherein said lips of a magazine are characterized by concave inner surfaces which correspond generally to the outer surface of said cartridges and together with the upper edges of the lips and said ridges firmly retain said uppermost cartridge at an oblique angle relative to the axis of said barrel whereby said uppermost round is retained in its rearward position in the magazine notwithstanding the kinetic energy of recoil generated upon firing of the pistol.

4. The improved magazine, as set forth in claim 2, wherein said bridging member comprises a portion of the front wall that extends outwardly and upwardly from the upper edge portion of said magazine.

5. The improved magazine, as set forth in claim 2, wherein said bridging member has a concave upper surface which corresponds generally to the curvature of the front wall portion of the magazine from which said member is formed.

6. The improved magazine, as set forth in claim 4, in which said bridging member has a concave configuration adapted to engage in surface-to-surface contact with the outer surface of the bullet portion of said cartridge while guiding the same upwardly toward the inclined ramp.

7. The improved magazine, as set forth in claim 5, in which said bridging member is of such a size as to substantially bridge any gap between the forward wall of the magazine and the wall of the lower end portion of the inclined ramp.

* * * * *